United States Patent [19]

Gastebled

[11] Patent Number: 4,607,880

[45] Date of Patent: Aug. 26, 1986

[54] KNOCKDOWN PICNIC TABLE

[76] Inventor: Yves Gastebled, 443 St-Vincent, Montreal, Quebec, Canada, H4N 3A6

[21] Appl. No.: 590,972

[22] Filed: Mar. 19, 1984

[30] Foreign Application Priority Data

Mar. 18, 1983 [CA] Canada ..... 423908

[51] Int. Cl.[4] ..... A47B 37/04

[52] U.S. Cl. ..... 297/157; 108/155; 297/159

[58] Field of Search ..... 297/121, 157, 159, 172; 108/101, 111, 154, 155; 248/165

[56] References Cited

U.S. PATENT DOCUMENTS

| | | | |
|---|---|---|---|
| 2,277,948 | 3/1942 | Bales | 108/101 |
| 2,670,031 | 2/1954 | Melges | 297/157 X |
| 2,717,631 | 9/1955 | Howe . | |
| 2,722,971 | 11/1955 | Gallagher et al. . | |
| 2,746,525 | 5/1956 | Cooper | 297/157 |
| 2,805,708 | 9/1957 | Bohn . | |
| 2,917,108 | 12/1959 | Moritz . | |
| 3,276,815 | 10/1966 | Cardy . | |
| 3,361,088 | 1/1968 | Hodgkin . | |
| 3,574,393 | 4/1971 | Hughes . | |

FOREIGN PATENT DOCUMENTS

| | | | |
|---|---|---|---|
| 778306 | 3/1935 | France | 297/172 |
| 294633 | 11/1953 | Switzerland | 297/172 |

*Primary Examiner*—William E. Lyddane
*Assistant Examiner*—Peter R. Brown
*Attorney, Agent, or Firm*—Schwartz, Jeffery, Schwaab, Mack, Blumenthal & Evans

[57] ABSTRACT

A knockdown picnic table having a table top, two benches, and four supports for connecting the benches to the top at the proper position and for supporting the benches and the top on the ground. Each support slidably engages one corner of the table top in one direction, and one end of a bench in a direction transverse to the one direction to securely lock the table top and benches together.

1 Claim, 3 Drawing Figures

KNOCKDOWN PICNIC TABLE

The present invention relates to a knockdown table and more particularly to a knockdown picnic table having a bench on each side of a table top.

Knockdown picnic tables are well known. However the known tables have disadvantages. Many of the tables require separate small fasteners, and tools, to assemble and disassemble the table. The fasteners are often lost. Many of the known tables also requrie a large number of individual parts thus making the tables expensive to manufacture. Many of the known tables also are not structurally sound when assembled. The assembled table often sways creating an impression of instability. It is often necessary to provide bracing to securely tie the table parts together.

It is the purpose of the present invention to provide an improved knockdown picnic table which can be easily assembled and which does not require separate fasteners or tools to assemble it.

It is another purpose of the present invention to provide an improved knockdown picnic table which has a minimum of separate parts, and in which the separate parts are all relatively large to minimize the chance of losing them.

It is a further purpose of the present invention to provide a knockdown picnic table which <<locks>> solidly together, without bracing when assembled, providing a strong, rigid structure.

In accordance with the present invention, there is provided a knockdown picnic table having seven parts, consisting of a table top, two benches, and four supports. The supports are specially constructed so that each support slidably connects with one end of a bench and one corner of the table top to both connect the bench to the table top in proper position, and to support the bench and the top on the ground. The slidable connections eliminate the need for separate fasteners and tools to assemble the bench.

Each support is constructed to slidably connect with the table top in one sliding direction, and with a bench in a second sliding direction which is transverse to the one of the first connection. This arrangement securely <<locks>> the benches and the table top together. With the connections made in two different sliding directions, the supports are also securely <<-locked>> between the benches and the table top and no additional bracing is needed to prevent swaying.

The invention is particularly directed toward a knockdown table having a top, at least one bench, and two supports for each bench. Each support has ground engaging means and first means extending up from the ground-engaging means to slidably engage the top in one direction. Second means also extend up from the ground-engaging means to slidably engage the corresponding bench in a direction opposite to the one direction. The bench is positioned adjacent and below the top when the two supports are slidably engaged to both the bench and the top.

The invention will be better understood with reference to the following non restrictive description of a preferred embodiment thereof, taken in connection with the accompanying drawings in which.

Figure 1:
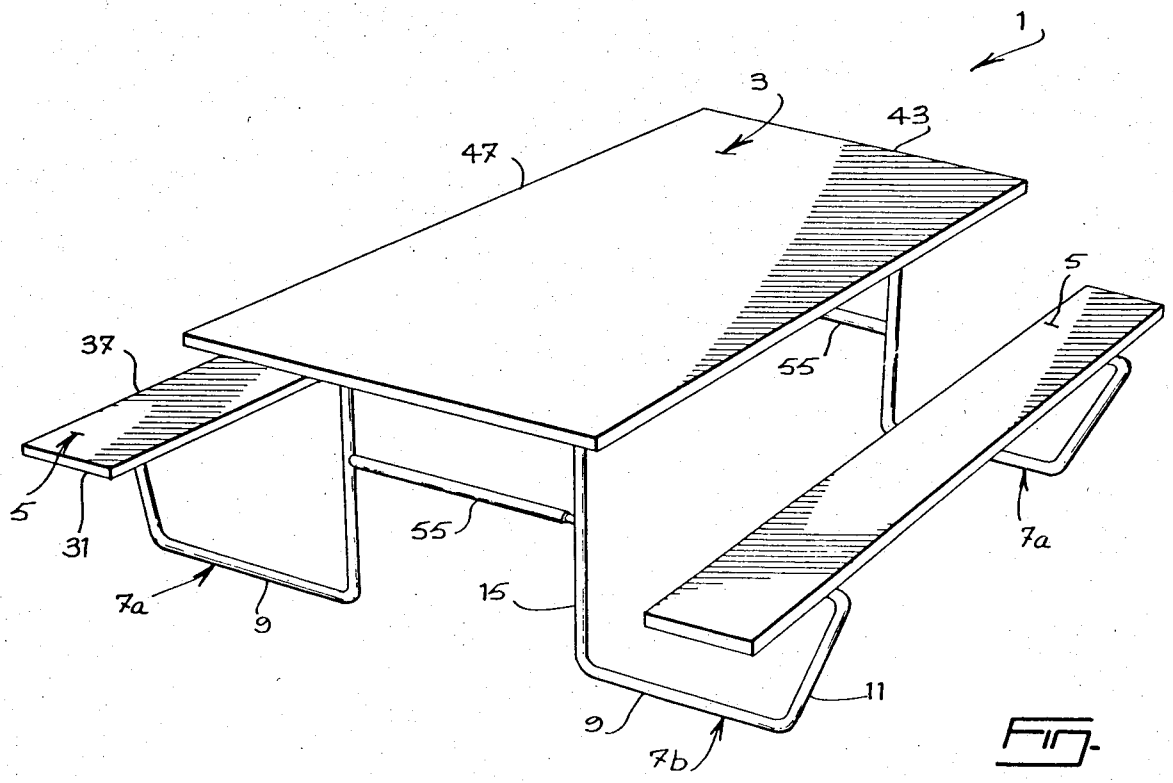
FIG. 1 is a perspective view of a picnic table according to the invention in its assembled position.
Figure 2:
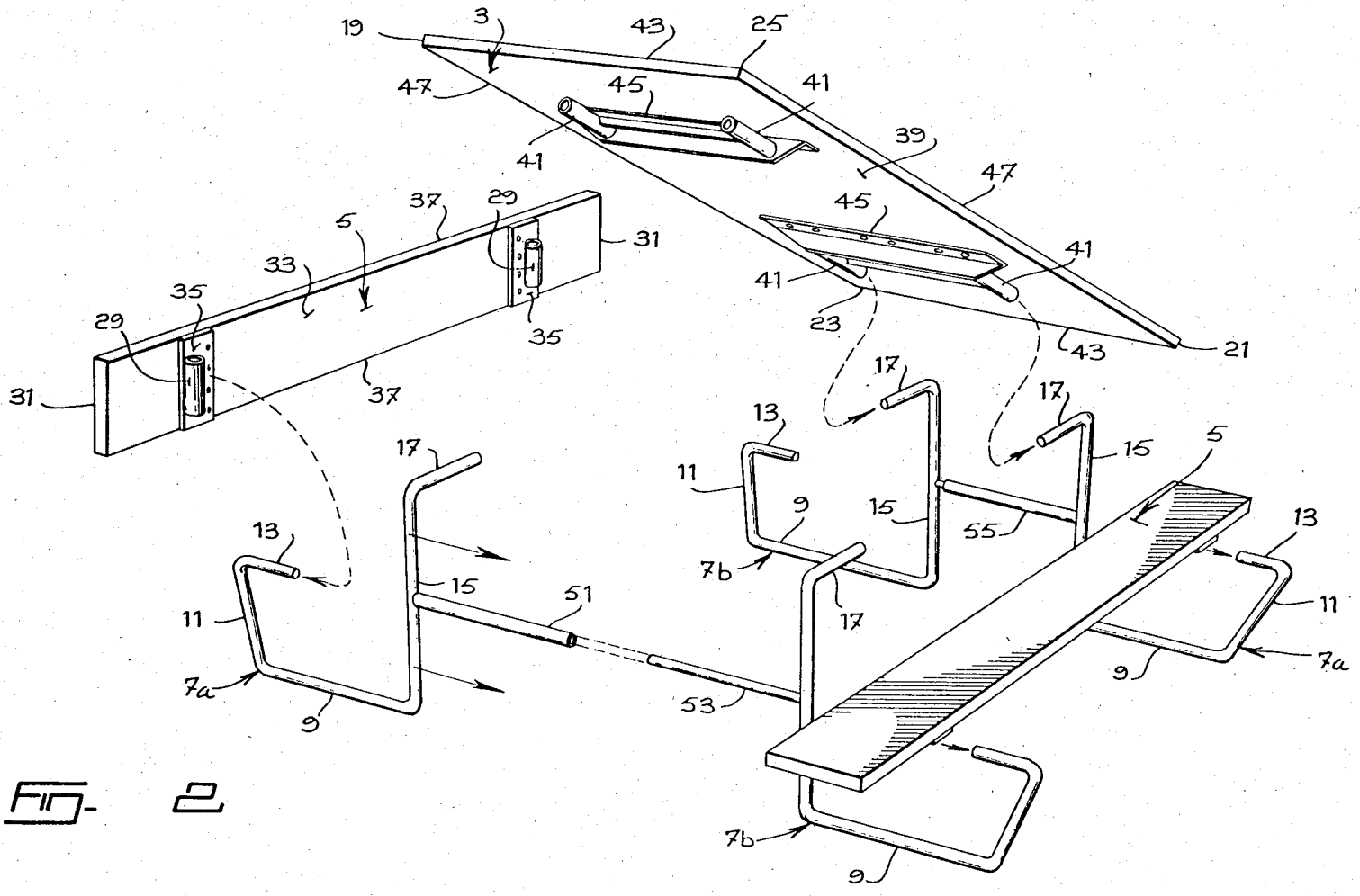
FIG. 2 is a perspective, exploded view of the picnic table shown in FIG. 1.

The picnic table 1 shown in FIGS. 1 and 2 includes a rectangular top 3 and two narrow, rectangular benches 5. Both the top 3 and the benches 5 can be made in one piece, or two or more pieces joined into a single, rigid unit.

Four supports 7 are provided for use in connecting the benches 5 and the top 3 off the ground at the proper height. Each support 7 has a ground-engaging portion 9. First means are carried by the ground-engaging portion 9 for slidably engaging with the table top 3 in one direction, and second means are carried by the ground-engaging portion 9 for slidably engaging with a bench 5 in a direction transverse to the one direction.

In more detail, the first means carried by the ground-engaging portion 9 comprise a first, upwardly-extending leg 15 having a first, short horizontal connector pin 17 at its upper end. The upward and horizontal directions are applicable to the support 7 when the table is set-up or assembled. The second means carried by the ground-engaging portion 9 comprises a second, upwardly-extending leg 11 having a second short, horizontal connector pin 13 at its upper end. The first connector pin 17 extends in a direction transverse to the second connector pin 13. The first leg 15 is longer than the second leg 11, and is used to support the table top 3, while the short leg 11 is used to support a bench 5. The second connector pin 13 preferably extends inwardly toward the first leg 15 but terminates short of it a distance greater than the width of a bench 5.

Each support 7 is preferably formed from a single piece of rod or tubing material bent to provide the ground-engaging portion 9, the legs 11, 15 and the connector pins 13, 17. The supports 7*a* at one set of diagonally opposed corners 19, 21 of the table top 3 are identical, while the supports 7*b* at the other set of diagonally opposed corners 23, 25 are also identical and differ from supports 7*a* only by having one of its connector pin 13, 17 extending in an opposite direction to the same connector pin on the supports 7*a*. Thus, as shown in FIG. 2, the connector pins 17 on supports 7*b* extend in an opposite direction to the connector pins 17 on supports 7*a*. Means are provided on each bench 5 for slidably receiving two connector pins 13. Each bench, as shown in FIG. 2 has a tubular receptor 29 mounted near or adjacent each end 31 of the bench 5, and on its bottom surface 33, by a mounting plate 35. In the embodiment shown, each receptor 29 extends longitudinally transverse to the long sides 37 of the bench 5.

Means are also provided near each corner of the table top 3 on its bottom surface 39, for receiving the four connector pins 17. These means comprise a tubular receptor 41 at each corner. The two receptors 41 at each narrow side 43 of the table top are fastened to the bottom of the table top 3 by a single mounting plate 45. In the embodiment shown, each tubular receptor 41 extends longitudinally in a direction parallel to the long sides 47 of the table top 3, and parallel to the long sides 37 of the benches 5 in the set-up table.

The table 1 is readily assembled by first mounting one support 7 at each corner of the table top 3 by sliding the connector pin 17 of each support 7 into a receptor 41 at each corner. One bench 5 is then mounted on the two supports 7 adjacent one long side 47 of the table top 3 by sliding its two receptors 29 onto the horizontal connector pins 13 of the supports 7. The other bench 5 is mounted in a similar manner on the connector pins 13 of the other two supports.

By having the connector pins 13, 17 on each support 7 at right angles to each other, the supports 7 are <<-locked>> in place when slidably connected to the benches and table top. The table top 3 locks the supports 7 against movement in a direction transverse to its long sides 47, and the benches 5 lock the supports 7 against movement in a direction parallel to the long sides 47 of the top 3. With the supports 7 thus <<-locked>>, the table top 3 and benches 5 are also securely held in place.

Figure 3:
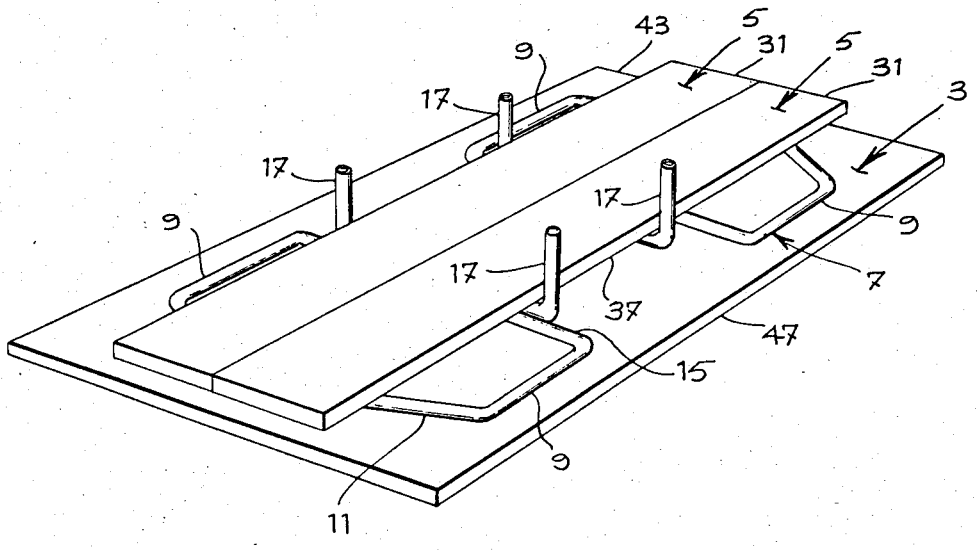
FIG. 3 is a perspective view of the picnic table shown in FIGS. 1 and 2 in its knockdown, stored position.

Assembly of a rigid table is quick and simple. No tools, or separate fasteners or connectors are needed. The table consists of only seven parts which are compactly stored in a knockdown condition of the table as shown in FIG. 3. The parts of the table are large enough to make it difficult to lose any of them.

If desired, each support *7a* may be provided with brace means cooperating with brace means on the support *7b* directly across from it. As shown in FIG. 2, the brace means on each support *7a* may comprise a tubular member 51 extending horizontally inwardly from about the midpoint of vertical leg 15. The cooperating brace means on each support *7b* comprises a member 53 which extends horizontally inwardly from about the midpoint of vertical leg 15 on support *7b*. Member 53 is snugly, slidably received within tubular member 51 when the supports 7 are used to mount table top 3 to the benches 5 to provide horizontal cross-braces 55 extending between the supports 7 at the ends of the table.

The embodiments of the invention in which an exclusive property or privilege is claimed are defined as follows:

1. A knockdown table comprising:

a table-top having four corners and two long sides, said table-top being provided with a tubular receptor extending parallel to its long sides near each corner;

a pair of narrow, rectangular benches each positioned on one long side of, and below, the table-top, each of said benches being provided near each end with a tubular receptor extending perpendicularly to the table receptors; and four supports for connecting the benches and the to together off the ground at a proper height, each of said supports comprising:

(a) a ground-engaging portion;

(b) a first leg extending up from said ground-engaging portion to support the table-top near one of its corners;

(c) a second leg extending up from said ground-engaging portion to support one end of one of said benches, said second leg being shorter than the first one;

(d) a first connecting pin extending horizontally at the upper end of the first leg in such a direction as to slidably engage the tubular receptor at the one corner of the table-top;

(e) a second connecting pin extending horizontally at the upper end of the second leg in a direction perpendicular to the direction of the first connecting pin so as to slidably engage the tubular receptor at the one end of the one bench, (f) each support being formed from a single piece of tubing material bent to provide the ground-engaging portion, the first and second legs and the first and second connecting pins;

(g) the supports located at diagonally opposed corners of the table-top are identical in shape, the supports located at one set of diagonally opposed corners having their first connecting pins extending in a direction opposite to the first connecting pins of the supports located at the other set of diagonally opposed corners; and (h) each support being provided with brace means cooperating with brace means provided on the support extending directly across from it at one end of the table-top to provide a cross-brace between the supports at said end of the table, said cooperating brace means comprising complementary telescopic, tubular members extending horizontally inwardly from about the mid-height of the first legs of the said respective supports;

whereby, by having the first and second connecting pins on each support at right angle to each other, the supports are locked in place when slidably connected to the benches and table-top, such a locking causing said benches and table-top to be securely held in place without tools, fasteners or separate connectors.

* * * * *